United States Patent [19]

Gheorghiu et al.

[11] 4,268,732

[45] May 19, 1981

[54] ARC QUENCHING CHAMBER FOR HIGH BREAKING CAPACITY CIRCUIT BREAKERS

[75] Inventors: Nicolae Gheorghiu; Basarab D. Guzun, both of Bucharest, Romania

[73] Assignee: Institutul de Cercetari si Modernizari Energetice, Bucharest, Romania

[21] Appl. No.: 812,729

[22] Filed: Jul. 5, 1977

[51] Int. Cl.[3] ..... H01H 33/70

[52] U.S. Cl. ..... 200/148 R; 200/150 R

[58] Field of Search ..... 200/148 R, 150 R, 150 G, 200/148 A

[56] References Cited

U.S. PATENT DOCUMENTS

| | | | |
|---|---|---|---|
| 2,573,797 | 11/1951 | Latour | 200/148 R |
| 4,034,175 | 7/1977 | Gratzmuller | 200/150 R |

FOREIGN PATENT DOCUMENTS

| | | | |
|---|---|---|---|
| 638145 | 11/1936 | Fed. Rep. of Germany | 200/150 G |
| 690593 | 4/1940 | Fed. Rep. of Germany | 200/150 G |
| 2339106 | 2/1975 | Fed. Rep. of Germany | 200/148 R |
| 520174 | 3/1955 | Italy | 200/148 R |
| 242106 | 9/1946 | Switzerland | 200/148 R |
| 575887 | 3/1946 | United Kingdom | 200/148 R |

*Primary Examiner*—Robert S. Macon

*Attorney, Agent, or Firm*—Karl F. Ross

[57] ABSTRACT

In a quenching chamber for a high voltage circuit breaker, a pair of separable contoured contacts are held in abutment by springs along a contact surface, a high velocity arc quenching stream flowable between the contact surfaces during the separation thereof, the contoured surfaces of the contacts defining a Coanda-type nozzle, which controls the flow of the stream along sharp bends in the surfaces, increasing the velocity of the stream and its arc quenching ability.

2 Claims, 8 Drawing Figures

ARC QUENCHING CHAMBER FOR HIGH BREAKING CAPACITY CIRCUIT BREAKERS

FIELD OF THE INVENTION

The present invention relates, in general, to circuit breakers, and, more particularly, to the construction of quenching chambers for high voltage circuit breakers.

BACKGROUND OF THE INVENTION

High voltage circuit breakers of the type using quenching chambers are known in the art, but have the disadvantage in that their breaking capacity is limited, so that in order to achieve a high capacity the breakers must be constructed as modules having identical chambers which can be ganged together when a higher capacity is needed.

This ganging method makes the breaker stage in a power system very cumbersome, but more importantly, their synchronous operation becomes difficult, endangering the stability of the entire power system.

SUMMARY OF THE INVENTION

The arc quenching chamber, according to the invention, eliminates this disadvantage by the fact that it is provided with a Coanda type nozzle for an arc quenching stream, which can be a separate piece made of an inexpensive material, e.g. copper, attacheable to the mobile contact by a contact surface, the entire assembly being pressed by a spiral spring into the contact position. Beginning from the moment of the main breakers' separation, the thin ionized stream is blown through the nozzle channel, the arc quenching stream being accelerated and deviated close to the contoured nozzle wall with an increase of the electric arc zone deionization effect achieved as well as a better flushing of its roots. A bending of the stream at the mouth of the nozzle is caused by a small step at the very lip of the mouth which facilitates the Coanda-effect of the internal type. Hollow arc quenching chambers can additionally achieve the external Coanda type effect, here the high pressure being located at first in their interior and from the moment the breakers are opened, the curving of the arc quenching stream to the contact's exterior is achieved, the deionization being easier in an external Coanda-nozzle. In another embodiment, the cross-blast type of quenching chamber has a fixed contact juxtaposed with high pressure cylinder slots having the shape of Coanda-nozzles, thus increasing the electric arc deionization effect.

OBJECT OF THE INVENTION

It is therefore an object of the present invention to provide a quenching chamber for a high voltage circuit breaker having a high breaking capacity.

It is another object of the present invention to provide a quenching chamber for a high voltage circuit breaker which will allow the breaker to have a relatively small overall size.

BRIEF DESCRIPTION OF THE DRAWING

The above and other objects, features and advantages of the invention will become more readily apparent from the following description, reference being made to the accompanying drawing, in which.

SPECIFIC DESCRIPTION

Figure 1:
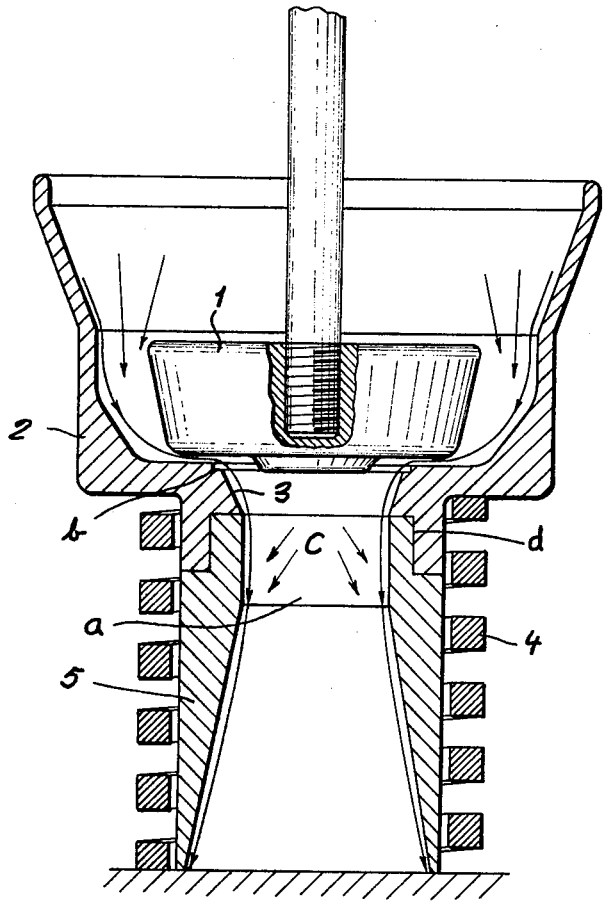
FIG. 1 is a longitudinal section view through the contacts of a breaker where the compressed air stream is led through an internal Conada-nozzle with a polygonal profile and a small step formed at the mouth of the nozzle.

The arc quenching chamber, according to the invention, shown in FIG. 1, is provided with a channel a for the flow of the quenching stream, having the shape of an internal type Coanda-nozzle. The area of the initial arc is limited by the surfaces of contacts 1 and 2, which move away very little during the first moments of circuit breaking, the surfaces being flushed by the thin stream formed between the contacts by the quenching fluid. Thus, the electric arc quenching occurs within the layer of thin jets flowing near the solid Coanda-type walls, near which the efficiency of the electric arc deionization is much higher. The flow of air emerging with supersonic speed through the thin circular slot formed during the first moments of opening of the contacts 1 and 2 is bent and accelerated in the area of wall 3 which forms the polygonal profile of the internal Coanda-type nozzle. During the moments following immediately after the opening, the plasma nucleus generated by the electric arc contributes to the increase of the quenching wave front which is directed even more towards the cold wall of the nozzle, increasing the deionization effect of the arc area.

For the purpose of bending the quenching fluid at the mouth of the nozzle, a small step b is formed near the lip of the mouth, the efficiency of the Coanda phenomenon depending on the precise formation of the nozzle profile, as well as on the size of the small step at the aperture. The electric arc whose roots lay initially on the contacts 1 and 2 is stretched and cooled more efficiently due to the fluid stratas which flows near the wall with a higher speed than the initial speed of the jet. The fresh fluid molecules c from the central area of the channel are driven towards the nozzle wall where the pressure is higher due to the Coanda-effect, The effect wherein in this case the electric arc is more efficiently flushed as compared to the ordinary shape of the known contacts which do not use the Coanda-effect in the quenching chamber. The nozzle a can be constructed as a separate piece 5 made of a cheaper material, e.g. copper, avoiding thus the expensive materials of which the main contacts 1 and 2 are made and is attached to the movable contact piece 2 by a contact surface d, the assembly 2,5 being pressed by a spiral spring 4 into engagement with stationary contact 1.

Figure 2:
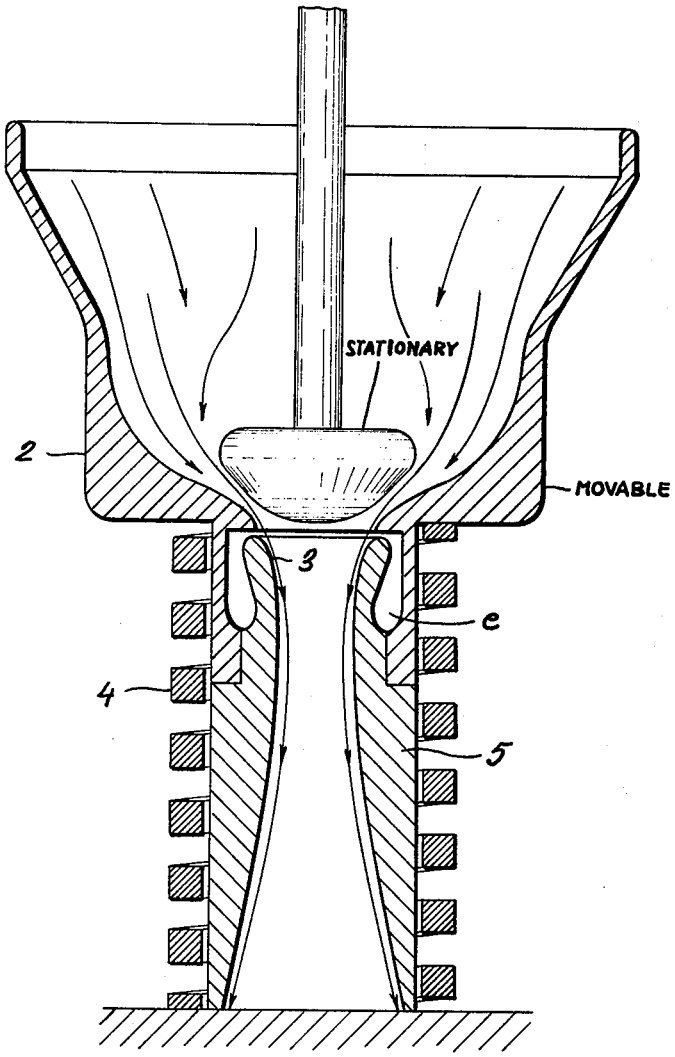
FIG. 2 is a longitudinal section through the contacts of a circuit-breaker where the internal type Coanda-nozzle has a contour in the form of a continuous curve, and the lip of the mouth has an inner shaped hollow step.

The internal type Coanda-nozzle can be formed with a contour following a continuous curve, while step b near the lip of the mouth can have the simple shape from FIG. 1 or the shape of an internal cavity e as in FIG. 2.

Figure 3:
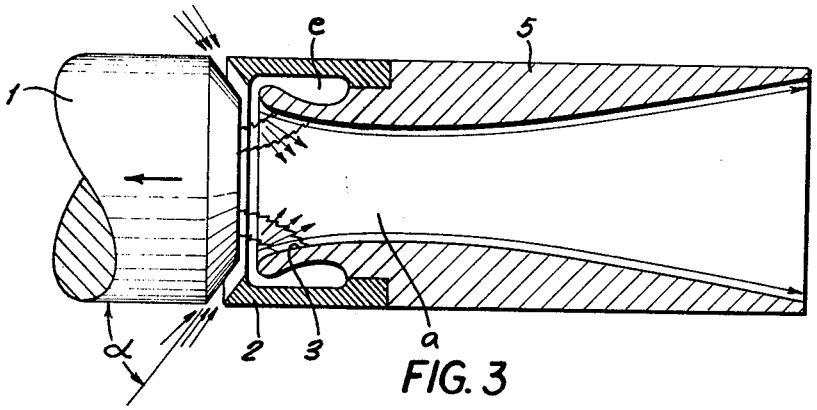
FIG. 3 is a longitudinal section through the quenching chamber of a hollow contact cross-blast high voltage circuit breaker.

The same nozzle shapes are used also in the case in which only one of the contacts 2 is of a tubelike configuration, as in FIG. 3, where the incidence angle, formed between contacts 1 and 2, of the thin and circular jet stream shape can have different values between zero and a value $\alpha$ where the arc roots flushing effect is more efficiently performed.

Figure 4:
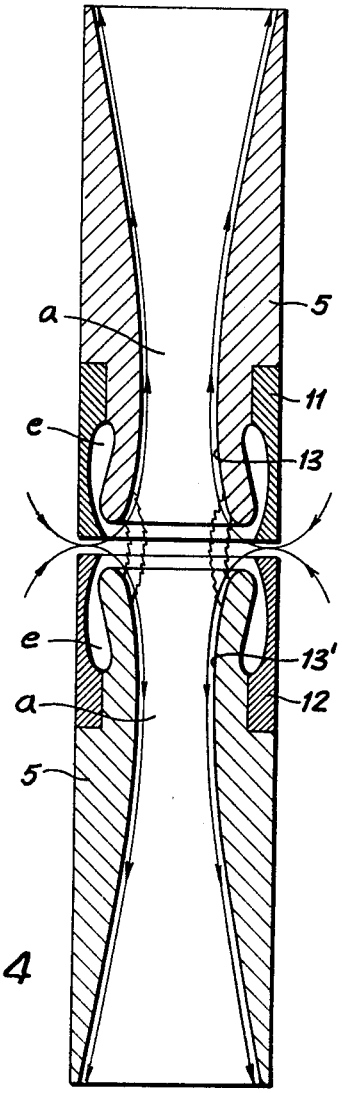
FIG. 4 is a longitudinal section through the contacts of a circuit breaker with both contacts being hollow.
Figure 5:
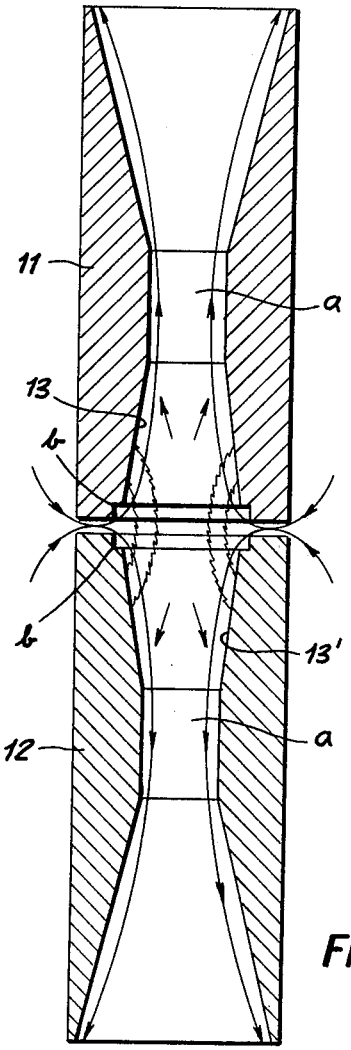
FIG. 5 is a longitudinal section through the contacts of the circuit-breaker which provides an internal type Coanda-nozzle with polygonal contour and a step at the very lip of the mouth.

When both contacts 11 and 12 are hollow, as shown in FIGS. 4 and 5, the admission of the quenching stream to the interior of the contacts is in a normal plane on the longitudinal axis, the fluid stream in the interior being split and bent towards each of the Coanda profile walls 13 and 13', the contacts 11 and 12 being provided with cavities e, similar to those shown in FIGS. 2 and 3.

Figure 6:
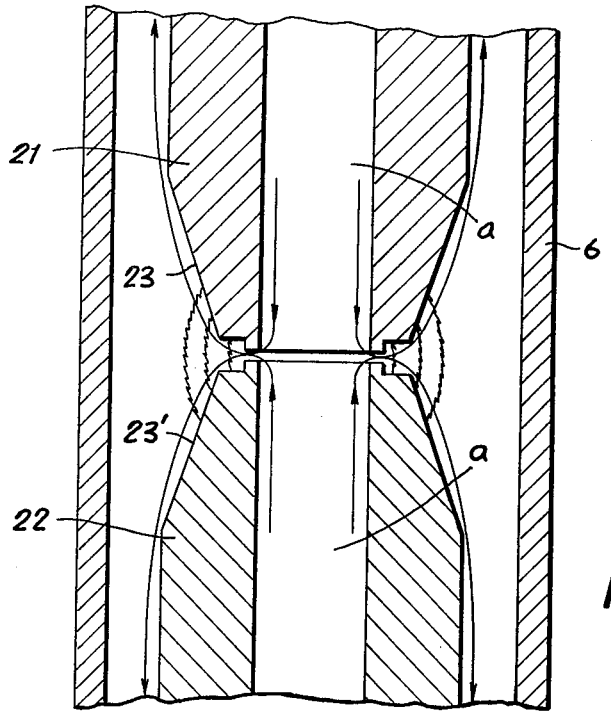
FIG. 6 is a longitudinal section through two contacts with the external surface having a contour which enables the obtaining of the Coanda-effect externally of the nozzle.
Figure 7:
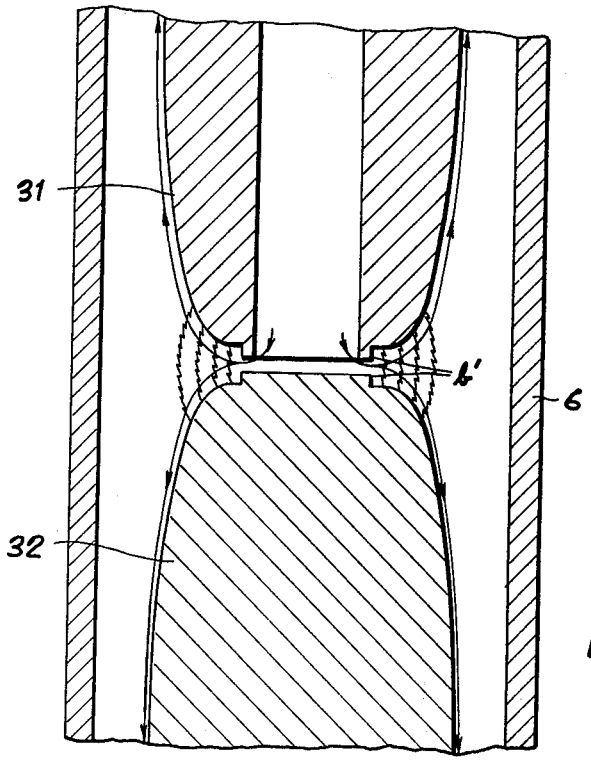
FIG. 7 is a longitudinal section through two contacts which create the external type Coanda-effect, one of the contacts being hollow, the other one being solid.

FIG. 6 shows an arc quenching chamber whose both contacts 21 and 22 are hollow, their external surfaces 23 and 23' representing the profile of an external type Coanda nozzle a. Here, the quenching fluid flows from the interior of the contacts 21 and 22 towards the exterior of surfaces 23 and 23'. In the external type Coanda-nozzles 31 and 32, the fact that the solid contact 32 is not hollow is not extremely important, since the Coanda-effect takes place for both contacts, this increasing significantly the breaking capacity of the breakers' blast chamber shown in FIG. 7. Of a great importance, besides the geometry of the step b' near the lip, of the mouth is also the distance between wall 6 and contacts 31 and 32, the high pressure being located in the interior of the contacts, so that the wall 6 can be dimensioned for a lower mecanic resistance, as compared to the usual types of circuit-breakers, resulting in a material economy. The present quenching chamber according to the invention, can be used in any type of modern circuit-breaker operating on blast air, sulphur hexafluoride, low oil content etc.

Figure 8:
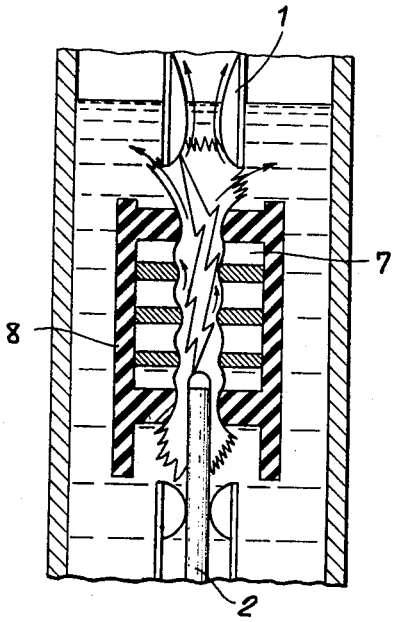
FIG. 8 is a longitudinal section through the arc quenching chamber of an immersion type cross-blast circuit-breaker.

For instance, in the case of a circuit-breaker of the oil-filled crossblast type, as shown in FIG. 8, the contact walls 1 are formed to obtain a Coanda-type nozzle, the same formation being applied to the slots formed in blast chamber 7 and to the interior baffels 8 of synthetic material 8, so that the gas and oil stream should flow as easy as possible, clinging to the Coanda profile walls, with the electric arc quenching chamber efficiency being increased, with the rest of the parts as well as the production technology remaining essentially unchanged.

The circuit-breaker, according to the invention, has the following advantages:

It enables the increase of the high-voltage circuit-breakers breaking capacity, the performance being achieved irrespective of the shape of both hollow contacts, or only one of them being of a hollow type, such as a funnel, etc., independent of the nature of the agents used, such as blast air, sulphur hexafluoride, oil, expansine etc. and not depending on the internal geometric form of the quenching chamber or its dimension;

The contruction changes necessary to existing circuit-breakers chambers are minimal, just the addition of a Coanda type nozzle, these changes being possible with the usual circuit-breakers types, irrespective of the extinguishing agent employed; and It enables the reduction of the use of expensive materials, especially when the Coanda effect of external type is used.

We claim:

1. A quenching chamber for a high-voltage circuit breaker, wherein said chamber comprises:

a first contoured fixed electrode;

a second contoured movable electrode positioned to abut said first electrode along mutual contact surfaces and axially separable therefrom to form a slit between said contact surfaces for a high-velocity arc-quenching stream flowable between said contact surfaces during the separation thereof, said second electrode having an outwardly flaring cup wholly receiving said first electrode to form, in the direction of said stream travel, an increasingly constricted, velocity-increasing gas-flow passageway with said first electrode upstream of said slit, said second electrode having a tubular portion inwardly of said slit and leading away from said first electrode, said cup being fixed to said tubular portion, said tubular portion forming a channel converging initially axially away from said slit and thereafter diverging axially away from said slit;

an inwardly facing step formed by a counterbore in said second electrode directly at the junction of said cup and said tubular portion between said slit and said channel for inducing said stream to adhere to and form a Coanda flow along the surface of said channel; and spring means for biasing said second electrode toward said first electrode.

2. A quenching chamber for a high-voltage circuit breaker, wherein said chamber comprises:

a first contoured fixed electrode;

a second contoured movable electrode positioned to abut said first electrode along mutual contact surfaces and axially separable therefrom to form a slit between said contact surfaces for a high-velocity arc-quenching stream flowable between said contact surfaces during the separation thereof, said second electrode having an outwardly flaring cup wholly receiving said first electrode to form, in the direction of said stream travel, an increasingly constricted, velocity-increasing gas-flow passageway with said second electrode upstream of said slit, said second electrode having a tubular portion inwardly of said slit and leading away from said first electrode, said cup being fixed to said tubular portion, said tubular portion forming a channel converging initially axially away from said slit and thereafter diverging axially away from said slit;

a step defined by the lip of an annular cavity formed in said second electrode directly at the junction of said cup and said tubular portion between said slit and said channel and communicating with said stream for inducing said stream to adhere to and form a Coanda flow along the surface of said channel; and spring means for biasing said second electrode toward said first electrode.

* * * * *